United States Patent [19]

Ritter, Jr.

[11] 4,127,185

[45] Nov. 28, 1978

[54] FIRE ESCAPE NET

[76] Inventor: Henry Ritter, Jr., 1001 Balmoral Dr., Nashville, Tenn. 37220

[21] Appl. No.: 800,719

[22] Filed: May 26, 1977

[51] Int. Cl.[2] ..... A62B 1/22

[52] U.S. Cl. ..... 182/140

[58] Field of Search ..... 182/137, 138, 139, 140, 182/142

[56] References Cited

U.S. PATENT DOCUMENTS

| | | | |
|---|---|---|---|
| 501,343 | 7/1893 | Herzberg | 182/142 |
| 567,642 | 9/1896 | Fitzhugh | 182/138 |
| 663,856 | 12/1900 | Browder | 182/140 |
| 688,436 | 12/1901 | Richter | 182/142 |
| 3,805,916 | 4/1974 | Milam | 182/138 |
| 3,921,757 | 11/1975 | Kennedy | 182/140 |

FOREIGN PATENT DOCUMENTS

| | | | |
|---|---|---|---|
| 950,755 | 10/1956 | Fed. Rep. of Germany | 182/138 |

*Primary Examiner*—Reinaldo P. Machado
*Attorney, Agent, or Firm*—Harrington A. Lackey

[57] ABSTRACT

A fire escape device including a collapsible frame from which is suspended a large receptacle, preferably of net material, and support means for the frame to support the frame and receptacle in a collapsed position within the interior of a building, and permitting protraction of the frame and receptacle to an extended and open position outside the exterior wall of the building for receiving persons falling from an opening, such as a window, vertically above the receptacle.

7 Claims, 6 Drawing Figures

FIRE ESCAPE NET

BACKGROUND OF THE INVENTION

This invention relates to an emergency escape device, and more particularly to a fire escape net.

Heretofore, most fire escape devices include ladders and stairways mounted on the exteriors of buildings leading from doors or windows on various floors of the building. Also, fire escapes have included ropes and rope ladders of various types stored in one or more rooms of a multi-storied building for suspension from an open window of the room in case of a fire or other emergency.

Firemen, of course, have been equipped for many years with large fire nets adapted to be hand-held about the periphery thereof adjacent the ground for receiving persons jumping or falling from openings in a burning building. Such nets, of course, present limitations on the height a person may fall and still be safely received in the net.

Fire escape stairways are limited by their fixed locations, which may or may not be accessible to persons in a burning building, depending upon the location of the fire.

SUMMARY OF THE INVENTION

It is therefore an object of this invention to overcome the disadvantages of the above known fire escape devices, by providing a fire escape net which is preferably collapsible and extendable, as well as maneuverable and mobile.

The fire escape net device made in accordance with this invention includes an open frame including a pair of opposed horizontal arms adapted to be moved toward and away from each other between an inoperative, collapsed position and an operative, open position. Suspended from the frame is a large receptacle, preferably of flexible material, such as net having an enclosed side wall and a resilient closed bottom wall for receiving persons falling from a height above the net device.

The frame is preferably mounted upon a support device within a room of a building having an opening through the exterior wall. The support device is adapted to support the frame in a retracted inoperative position within the room and also to support the frame for protraction out through the opening in the exterior wall to an operative position where the frame is opened and held for receiving persons falling from heights vertically above the frame.

If desired, the support means may be provided with a wheeled carriage so that the entire fire escape device may be moved from room to room, or even from floor to floor, so that the device may be mounted for operation in a location accessible to persons escaping from the fire in a burning building, or from other catastrophes.

Also, the receptacle preferably includes an inflatable bottom member adapted to be inflated as the frame opens to its operative position.

The receptacle may also be provided with one or more escape doors formed in the side wall of the receptacle, from which persons who drop into the net may have means of exiting therefrom, such as through an open window in the floor below the opening in which the escape device is supported.

The fire escape net is also preferably provided with spreader arms pivotally connected to the frame arms for projecting upward and diverging outward a funnel-shaped entry net to enlarge the target opening through which persons fall into the net receptacle.

BRIEF DESCRIPTION OF THE DRAWINGS

FIG. 4 is a side elevation of the device disclosed in FIG. 1 in protracted, but collapsed position, with the building shown fragmentarily;

DESCRIPTION OF THE PREFERRED EMBODIMENTS

Figure 3:
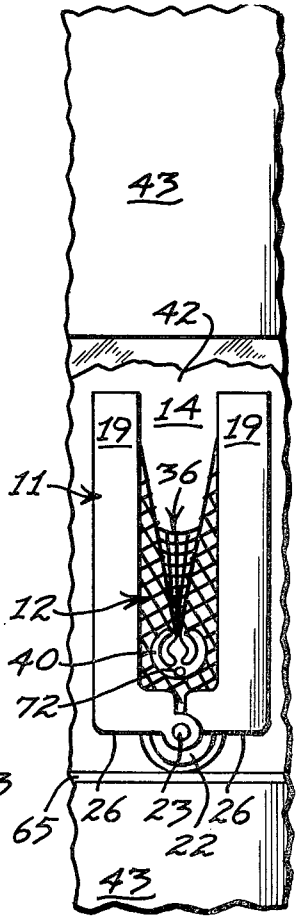
FIG. 3 is a front end elevation of the device disclosed in FIG. 1, with the building disclosed fragmentarily.

Referring now to the drawings in more detail, the fire escape device 10 includes an open frame 11 from which is suspended a flexible receptacle 12 and which is mounted upon a support mechanism 13 within a room 14 of a multi-story building 15.

Figure 6:
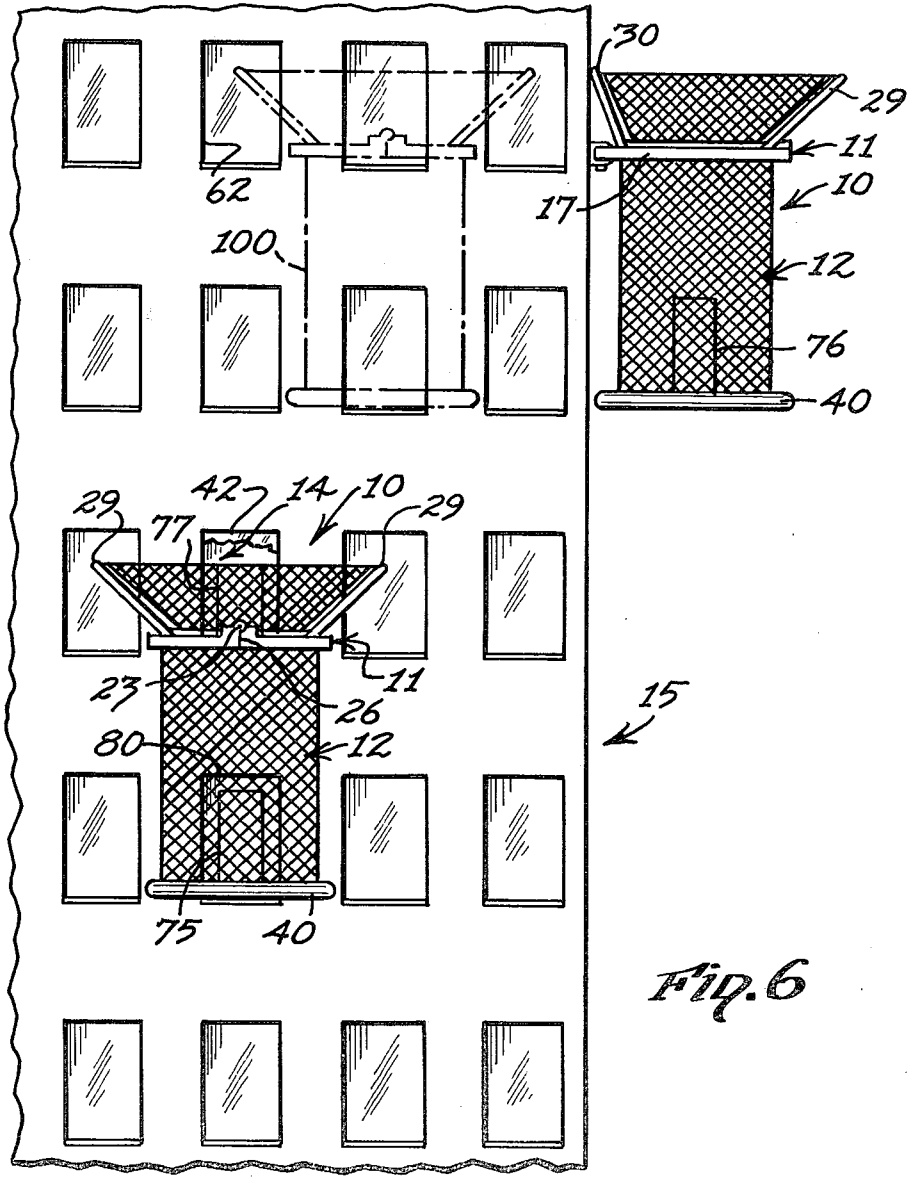
FIG. 6 is a fragmentary side elevation of a multi-story building disclosing two fire escept net devices of FIG. 5 in side and front elevations at different floors of the building, in their protracted and fully opened positions, and a third net device in phantom.
Figure 5:
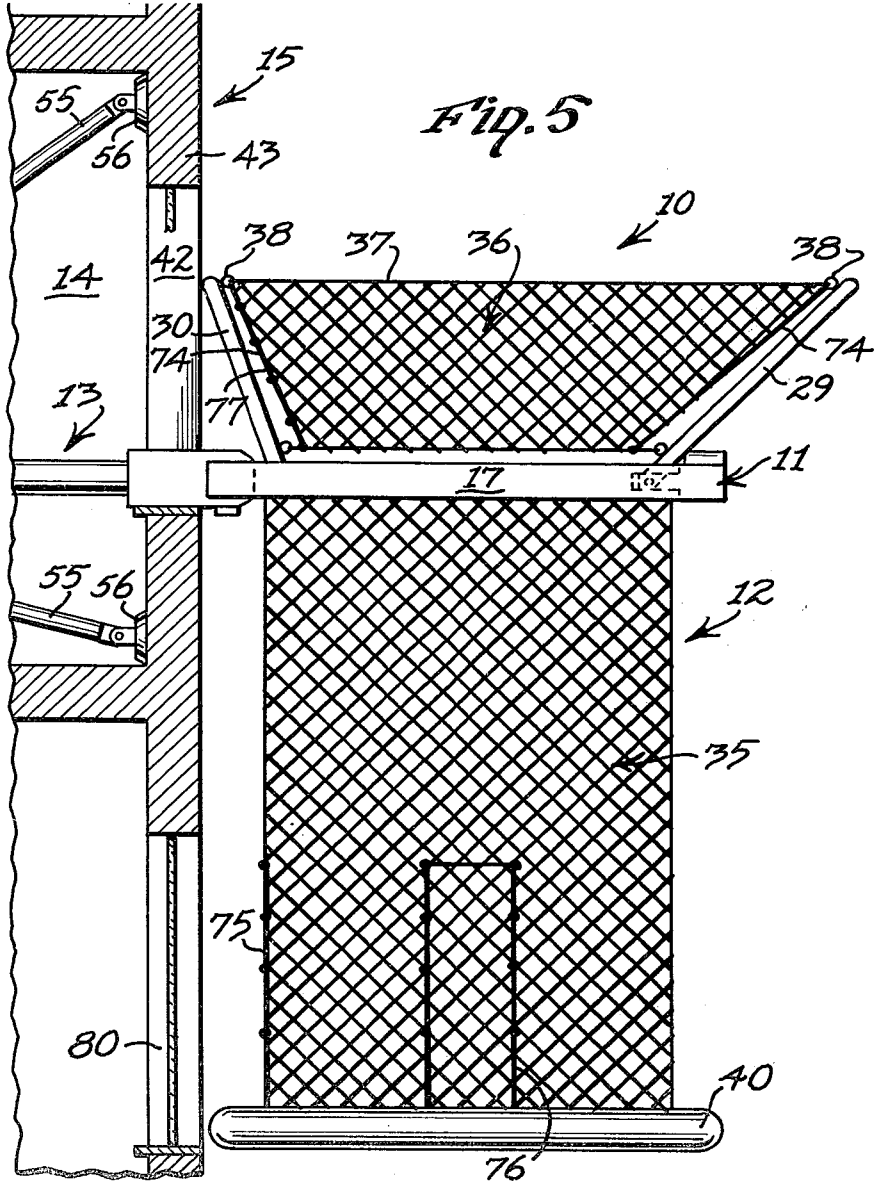
FIG. 5 is a fragmentary side elevation of the net device in its protracted but fully opened position, with doors in the walls of the nets.

The open frame 11 preferably includes a pair of opposed, parallel, horizontal arm members 17 which are adapted to move toward and away from each other between a collapsed position as disclosed in FIGS. 1–4 and an open position as disclosed in FIGS. 5 and 6.

As particularly disclosed in the drawings, the arm members 17 are preferably side arm members, the opposite ends of which are integrally connected with end arm members 18 and 19. The rear end arm members 18 are joined to each other by hinge collars 20 journaled upon the elongated, horizontal shaft 22 of the mounting mechanism 13.

The free ends of the front end arm members 19 are journaled to each other by the hinge pin 23, which lies in front of, but is coaxial with, the elongated shaft 22.

When the side frame arm members 17 are swung or rotated to their extended open position as disclosed in FIGS. 5 and 6, the free ends of the rear arm members 18 are provided with abutments 25 for engaging each other in the open position to prevent the arm members 17, 18 and 19 from swinging down below their horizontal open position.

In a similar manner, the front arm members 19 are prevented from being swung below their horizontal coplanar open positions by the abutment surfaces 26 (FIGS. 3 and 6).

Journaled by hinge pins 28 in the front corners of the frame 11, formed by the intersection of the side arm members 17 and the front arm members 19, are a pair of pivotal spreader arms 29. In like manner, a pair of rear spreader arms 30 are journaled by hinge pins 31 in the rear corners of the frame 11 formed by the intersections of the side arm members 17 and the rear arm members 18. A spring 32 is connected between the hinge pin 28 and the journaled end of each front spreader arm 29 to urge the front spreader arms 29 upward into forward diverging positions, as disclosed in FIGS. 5 and 6. In like manner, rear springs 33 are connected between the rear hinge pins 31 and the journaled ends of the rear spreader arms 30 to urge the rear spreader arms 30 into upper and rearward inclined positions, as disclosed in FIGS. 5 and 6, when the frame 11 is rotated to its open position.

The receptacle 12 is made of flexible material, and preferably of a flexible net material having an enclosed side wall 35 having a substantially rectangular cross-section. An upper entry net 36 is of a generally truncated pyramidal shape diverging upward to provide an enlarged open top end 37, which may be fixed at the corners thereof to the upper ends of the respective spreader arms 29 and 30, by means such as connecting rings 38. The bottom of the entry net 36 is open to permit passage into the receptacle net 12.

Figure 1:
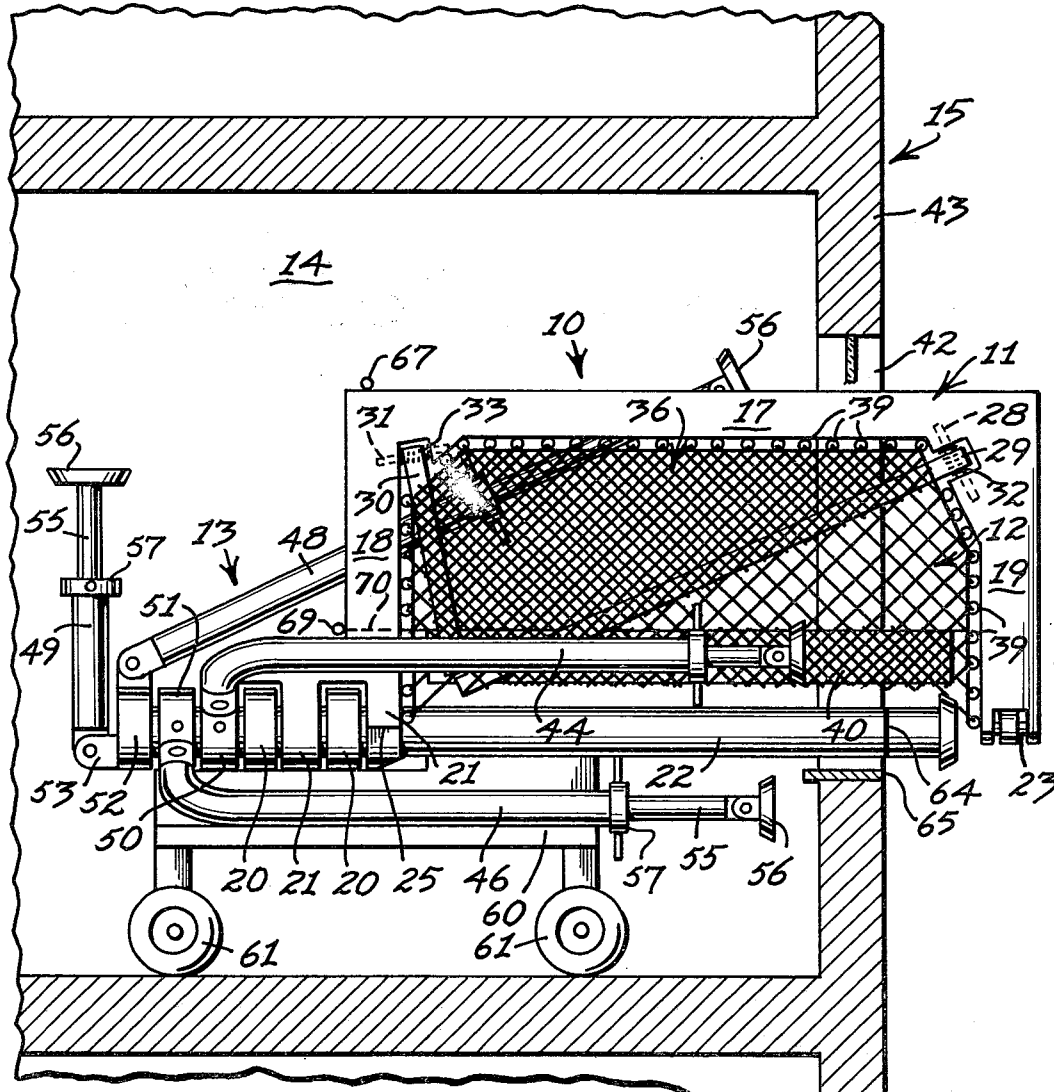
FIG. 1 is a side elevation of one form of the fire escape net device in its retracted, collapsed position, within an upper-story room of a building, shown fragmentarily.
Figure 2:
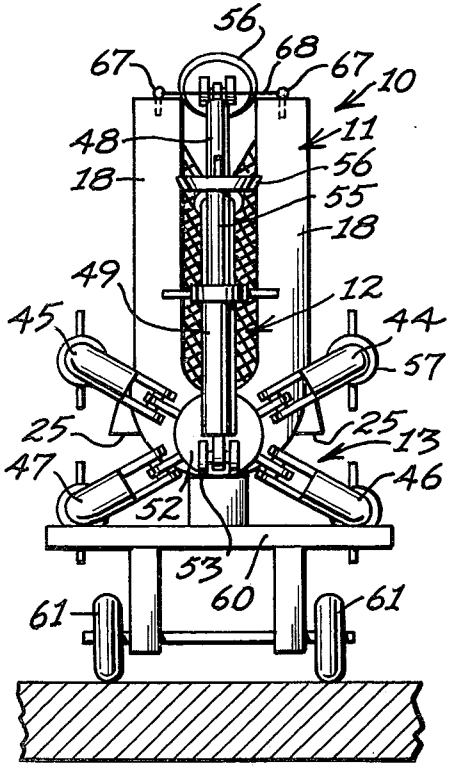
FIG. 2 is a rear end elevation of the device disclosed in FIG. 1, with the room floor disclosed fragmentarily.
Figure 1:
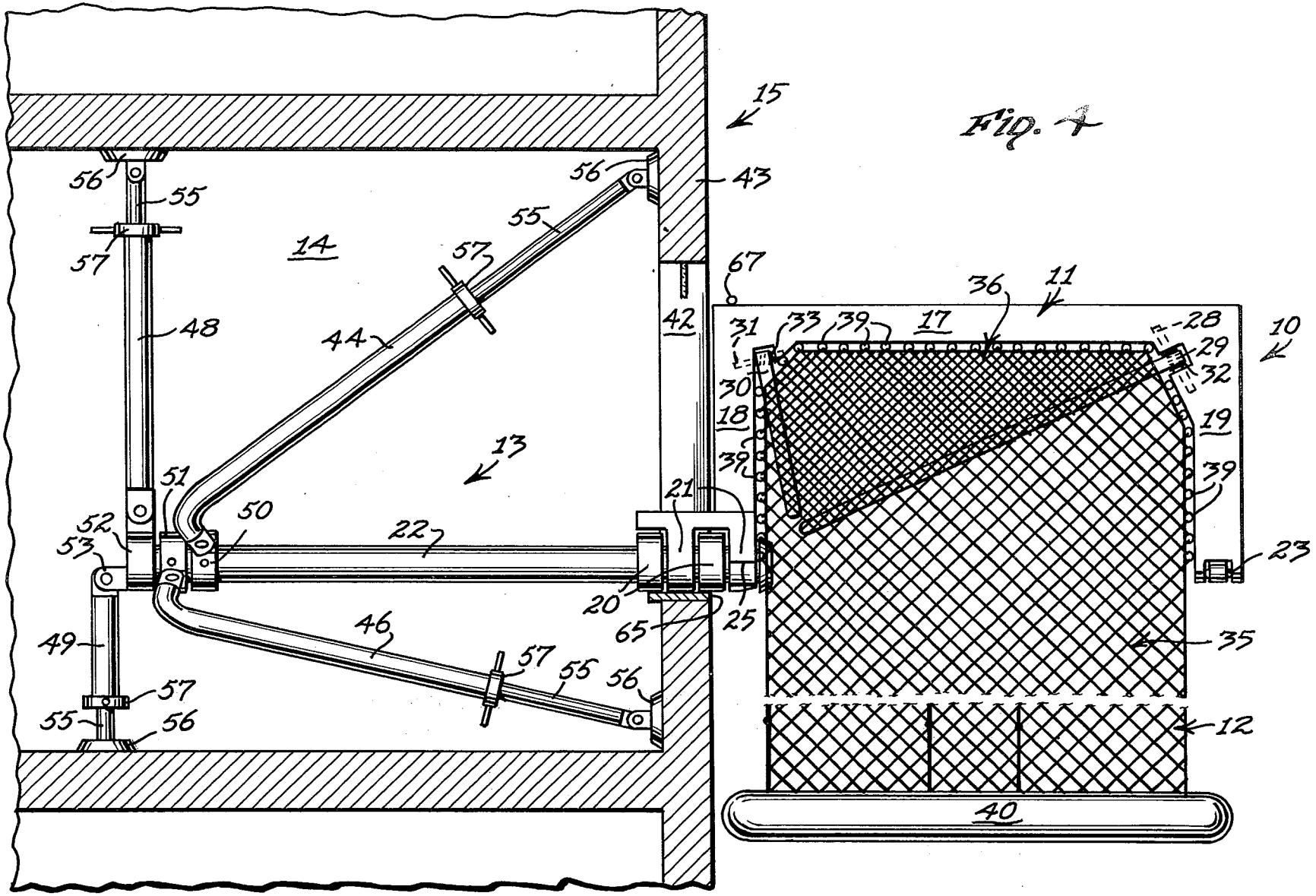

As disclosed in FIGS. 1 and 4, the open top edges of the side walls 35 of the receptacle 12 may be attached to the inner surfaces of the respective arm members 17, 18 and 19 by the attachment rings 39.

The bottom of the receptacle 12 is closed by a resilient bottom wall or floor, such as the inflatable hollow bottom wall member 40.

Not only are the hinge collars 20 and 21 journaled upon the elongated support shaft 22 to permit swinging movement of the opposed frame members 17, 18 and 19, but they also permit longitudinal reciprocable sliding movement of the frame 11 relative to the support shaft 22. Thus, with the frame sections 17, 18 and 19 swung together in collapsed inoperative positions as disclosed in FIGS. 1–3, the frame 11 may be pushed forward to move longitudinally along the shaft 22 until the frame 11 is moved to its protracted position, disclosed in FIG. 4, outside the opening or window 42 of an exterior building wall 43 of the building 15. When the frame 11 is in its protracted position disclosed in FIG. 4, then it is desirable to swing the frame arm members 17, 18 and 19 away from each other toward their horizontal coplanar open position as disclosed in FIGS. 5 and 6.

In order to hold the elongated shaft 22 in a rigid, stationary position within the room 14, not only for supporting the frame 11 and receptacle 12 in their collapsed retracted positions, but also in their protracted, open positions for receiving several persons jumping from a substantial height into the device 10, a plurality of telescoping standards or leg members 44, 45, 46, 47, 48 and 49 are provided. The two upper forwardly projecting telescoping leg members 44 and 45 are journaled upon a single collar 50 fixed to the rear end of the shaft 22. In like manner, the lower forwardly extending leg members 46 and 47 are journaled to a collar 51 fixed behind the collar 50 upon the shaft 22.

The top telescoping leg member or standard 48 is journaled upon collar 52 fixed to the shaft 22 behind the collar 51. The bottom telescoping leg member 49 is journaled to the journal bearings 53 fixed to the rear end of the shaft 22.

Each of the telescoping leg members 44–49 includes the projecting telescoping legs 55, to the free ends of which are journaled the footpads 56 for engaging the respective opposing wall surfaces of the room 14.

Furthermore, each of the telescoping leg members 44–49 is provided with a gland 57 adapted to be adjusted for tightening and loosening the respective telescoping legs 55, in order to adjust and lock the respective legs 55 into engagement with their respective room surfaces.

The shaft 22 may be supported upon a carrier 60 having wheels 61 to make the device 10 mobile, and more easily maneuverable, not only for positional adjustment within the room 14, but also for mobility to many alternate locations not in immediate danger of fire or catastrophe to the victims using the net device 10.

In the operation of the escape device 10, the device 10 may be located or stored in any desired place, such as the room 14, where it is generally accessible in the event of a fire or emergency. As viewed in FIG. 6, the device 10 may be located in a room 14 having a window 42 vertically below a window 62 through which victims or persons are to jump, in order to escape fire within the burning building 15. The device 10 is moved forward so that the front end of the shaft 22 will project through the window 42 until the circumferential mark 64 (FIG. 1) registers with the outer margin of the window sill 65. Then, all of the telescoping leg members 44–49 are sequentially swung to their operative positions disclosed in FIG. 4. The glands 57 are released, the respective legs 55 are extended until the corresponding footpads 56 are tightly engaged against the respective wall surfaces of the room 14, and the glands 57 are again tightened. With all of the leg members 44 thus locked, the elongated shaft 22 is rigidly supported within the room 14, for holding the frame 11 and the receptacle 12, even in their extended opened positions.

The operator of the device 10 then pushes the collapsed frame 11 forward through the open window 42. If the window 42 is not open, then the front end of the shaft 22 may be used as a battering ram to break the window pane. The frame 11 in its collapsed position is then moved along the shaft 22 until the entire frame 11 has been projected beyond the exterior surface of the outer wall 43.

The ring 69 of the rip cord 70 is pulled to permit the side wall netting 35 to unroll or unfold, and to simultaneously actuate the pressurized carbon dioxide cartridge 72 (FIG. 3) to simultaneously inflate the bottom wall inflatable member 40. The weight of the bottom wall member 40 will pull the side wall netting material 35 down into its stretched position as disclosed in FIG. 4.

One of the lanyard pins 67 is then removed from one of the side arm members 17 to release the lanyard 68 and permit the side frame arm members 17 to drop to their respective horizontal coplanar positions as disclosed in FIGS. 5 and 6. As the side arm members 17 drop, the coil spring 32 and 33 force the spreader arms 29 and 30 to their upward diverging positions, which thrust upward and outward the funnel-shaped entry net 36, as disclosed in FIGS. 5 and 6, in order to provide a larger target for the falling victims.

In order to protect persons falling into the open end 37 of the entry net 36 from injuring themselves on the spreader arms 29 and 30, protective cords 74 may be tautly mounted in alignment with and spaced inward from the inner surface of each of the respective spreader arms 29 and 30.

As disclosed in FIGS. 5 and 6, each of the receptacles 12 may be modified to include one or more exit doors 75, 76 and/or 77 in the net walls 35 and 36, respectively.

If the receptacle wall 35 is deep enough to extend downward to the next lower window opening 80, then the door 75 may be used by persons falling into the receptacle 12 for exiting to the next lower floor, where access to the ground level by conventional conveyances, such as stairways and elevators may be unobtruded.

Exit door 77 may be provided for exit through the same window 42 through which the frame 11 has been thrust, if such exit is available.

The door 76 is available for exit to the exterior of the building 15, such as by jumping from a net device 100 into another net device 10 at a lower and slightly staggered elevation (FIG. 6), or by employing a rope or rope ladder for escaping the remaining distance to ground level or to a lower rooftop.

After the emergency is over, or the fire has been extinguished and the device 10 is undamaged, then it can be recovered and re-used again, by deflating the inflatable bottom member 40, collapsing the spreader arms 29 and 30, folding together the side arm members 17, re-inserting the lanyard pin 67, and re-rolling the receptacle walls 35 into a collapsed roll, as disclosed in FIG. 3. Of course, a new $CO_2$ cartridge must be installed for reactivating the bottom wall member 40 in a future emergency. The collapsed and folded frame 11 and receptacle 12 are then retracted along the shaft 22 to their original stored position, and the various leg members 44–49 are released, disengaged, telescoped and folded to their original inoperative positions as disclosed in FIG. 1.

1. An emergency escape device comprising:

(a) a frame having a pair of opposed arms spaced apart sufficiently in an open position to receive the passage of a person between said arms, (b) a receptacle of flexible material having a circumferentially closed side wall, a resilient, closed bottom wall, and a top opening defined by the top margin of said side wall, (c) said top opening being large enough for the passage of a person therethrough and said receptacle being large enough to receive said person, (d) means securing said receptacle within said frame, (e) support means comprising an elongated horizontal shaft member adapted to project through an opening in the exterior wall of a building, (f) hinge means joining said opposed arms and journaled upon said shaft for longitudinal reciprocal movement of said frame upon said shaft between a retracted position within said building and a protracted position outside of said exterior building wall, (g) said hinge means being also journaled upon said shaft for pivotal movement of said frame arms about said shaft to permit said opposed arms to move toward each other to collapse said receptacle in an inoperative position and to move away from each other to an operative open position.

2. The invention according to claim 1 in which said flexible material is net material.

3. The invention according to claim 1 in which said resilient bottom wall comprises a hollow, inflatable member, and means for inflating said hollow member when said arms are in said open position.

4. The invention according to claim 1 further comprising spreader arms having upper ends and mounting means connecting said spreader arms to said frame arms for movement from a collapsed position toward an upper extended position, a funnel-shaped entry net having a larger top opening than a bottom opening, means supporting the top opening of said entry net to the upper ends of said spreader arms.

5. The invention according to claim 4 in which there are four of said spreader arms, said spreader arm mounting means pivotally connecting one lower end of each of said spreader arms to a corner portion of the frame defined by said opposed frame arms, and spring means biasing said spreader arms into upward diverging attitudes when said arms are in said open position.

6. The invention according to claim 1 further comprising telescoping leg means operatively connected to said shaft member for stationarily mounting said shaft member within the interior of said building for supporting said frame and said receptacle outside and adjacent said exterior building wall.

7. The invention according to claim 1 further comprising escape door means in the side wall of said receptacle.

* * * * *